US009385479B1

(12) United States Patent
Schmitt et al.

(10) Patent No.: US 9,385,479 B1
(45) Date of Patent: Jul. 5, 2016

(54) OVERMOLDED CONNECTOR SUB-ASSEMBLY

(71) Applicant: TYCO ELECTRONICS CORPORATION, Berwyn, PA (US)

(72) Inventors: Matthew Ryan Schmitt, Middletown, PA (US); Paul Steven Sremcich, Harrisburg, PA (US); Steve Douglas Sattazahn, Lebanon, PA (US); Brandon Michael Matthews, McAlisterville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/809,442

(22) Filed: Jul. 27, 2015

(51) Int. Cl.

| | |
|---|---|
| ***H01R 13/648*** | (2006.01) |
| ***H01R 13/6471*** | (2011.01) |
| ***H01R 24/60*** | (2011.01) |
| ***H01R 13/504*** | (2006.01) |

(52) U.S. Cl.
CPC ..... *H01R 13/6471* (2013.01); *H01R 13/504* (2013.01); *H01R 24/60* (2013.01)

(58) Field of Classification Search
CPC ..... H01R 13/652
USPC ..... 439/108, 328, 637
See application file for complete search history.

(56) References Cited

U.S. PATENT DOCUMENTS

| | | | | |
|---|---|---|---|---|
| 3,399,372 | A * | 8/1968 | Uberbacher | H01R 12/721 439/101 |
| 6,247,970 | B1 * | 6/2001 | Ueno | H01R 13/6585 439/108 |
| 7,819,675 | B2 * | 10/2010 | Ko | H01R 9/034 439/98 |
| 8,221,139 | B2 * | 7/2012 | Qin | H01R 13/6471 439/92 |
| 8,764,488 | B2 * | 7/2014 | Zeng | H01R 13/6585 439/108 |
| 8,858,237 | B2 * | 10/2014 | Hsu | H01R 13/514 439/60 |
| 8,858,243 | B2 * | 10/2014 | Luo | H01R 13/652 439/108 |
| 2004/0072467 | A1 * | 4/2004 | Jordan | H01R 12/775 439/492 |

* cited by examiner

*Primary Examiner* — Phuong Dinh

(57) ABSTRACT

A connector sub-assembly includes a dielectric carrier, plural signal conductors, and a ground frame. The dielectric carrier is defined by first and second overmolded bodies that engage one another at an overmold interface. An intermediate segment of each signal conductor is encased within the dielectric carrier. The ground frame is held between the first and second overmolded bodies at the overmold interface. The ground frame includes a ground bus bar encased within the dielectric carrier and plural ground conductors extending from the ground bus bar. The second overmolded body is formed in-situ on an inner side of the first overmolded body. An inner side of the second overmolded body at the overmold interface is partially defined by a profile of the inner side of the first overmolded body and partially defined by the ground frame.

20 Claims, 7 Drawing Sheets

OVERMOLDED CONNECTOR SUB-ASSEMBLY

BACKGROUND OF THE INVENTION

The subject matter herein relates generally to electrical connectors that convey high speed data signals.

High speed electrical connectors typically transmit and receive high speed data signals over pairs of signal conductors, referred to as differential pairs. Adjacent differential pairs of signal conductors are separated by ground conductors to reduce electrical interference, such as cross-talk, between the adjacent pairs. The signal conductors and ground conductors are held in place in a connector sub-assembly by a dielectric inner housing structure. In known connectors, the dielectric inner housing may include multiple mechanical fasteners and/or adhesives for assembling multiple portions of the inner housing to one another. The mechanical fasteners may include press-fit pins, latches, detents, or the like. The adhesives may refer to glue and other bonding agents, as well as to bonding operations such as ultrasonic welding. But, utilizing such fasteners and/or adhesives requires additional assembly steps. Also, joining multiple different portions of the inner housing using mechanical fasteners, for example, may have a negative effect on signal integrity through the electrical connector as the dielectric material is not uniform across the joints between assembled portions of the inner housing. Furthermore, due to the ever decreasing pitch of high speed input/output (I/O) connectors according to the ongoing trend towards smaller, faster, and higher performance connectors, there is reduced real estate available for designated fastening spaces where a mechanical fastener and/or an adhesive may be applied between portions of the inner housing.

A need remains for a high speed electrical connector that does not require mechanical fasteners or adhesives during assembly of an electrical sub-assembly that includes signal conductors and ground conductors.

BRIEF DESCRIPTION OF THE INVENTION

In an embodiment, a connector sub-assembly for an electrical connector includes a dielectric carrier, plural signal conductors arranged in a row, and a ground frame. The dielectric carrier is defined by first and second overmolded bodies. The first and second overmolded bodies have respective inner sides that engage one another at an overmold interface. Each signal conductor defines a mating signal contact, a terminating signal contact, and an intermediate segment therebetween. The intermediate segments are encased within the dielectric carrier. The mating signal contacts and terminating signal contacts extend from the dielectric carrier. The ground frame includes a ground bus bar and plural ground conductors joined to and extending from the ground bus bar. The ground bus bar extends across the signal conductors and is encased within the dielectric carrier. The ground conductors define mating ground contacts and terminating ground contacts that extend from the dielectric carrier to provide shielding between the mating signal contacts and the terminating signal contacts, respectively. The second overmolded body is formed in-situ on the inner side of the first overmolded body. The inner side of the second overmolded body at the overmold interface is at least partially defined by a profile of the inner side of the first overmolded body.

In another embodiment, a connector sub-assembly for an electrical connector includes first and second overmolded bodies, plural signal conductors arranged in a row, and a ground frame. The first and second overmolded bodies have respective inner sides that engage one another at an overmold interface. Each signal conductor defines a mating signal contact, a terminating signal contact, and an intermediate segment therebetween. A first set of the signal conductors form part of a first lead frame, and a second set of the signal conductors form part of a second lead frame. The intermediate segments of the signal conductors in the first set are encased in the first overmolded body. The intermediate segments of the signal conductors in the second set are encased in the second overmolded body. The ground frame is held between the first and second overmolded bodies at the overmold interface. The ground frame includes a ground bus bar and plural ground conductors joined to and extending from the ground bus bar. The ground bus bar extends across the signal conductors. The ground conductors define mating ground contacts and terminating ground contacts arranged in the row and providing shielding between corresponding mating signal contacts and terminating signal contacts, respectively. The second overmolded body is formed in-situ on the inner side of the first overmolded body. The inner side of the second overmolded body at the overmold interface is partially defined by a profile of the inner side of the first overmolded body and partially defined by the ground frame.

In another embodiment, a method of assembling a connector sub-assembly for an electrical connector includes overmolding signal conductors of a first lead frame in a first overmolded body. The signal conductors are arranged in pairs. Adjacent pairs of signal conductors are spaced apart from one another along a length of the first overmolded body. The method includes mounting a ground frame on an inner side of the first overmolded body. The ground frame includes a ground bus bar and grounding contacts that extend from the ground bus bar. A bottom side of the ground bus bar engages the inner side of the first overmolded body. The method also includes positioning signal conductors of a second lead frame along the inner side of the first overmolded body. The signal conductors in the second lead frame are arranged in pairs that are each disposed laterally between adjacent pairs of the signal conductors in the first lead frame. Intermediate segments of the signal conductors in the second lead frame are jogged around a top side of the ground bus bar that is opposite the bottom side such that the signal conductors are separated by a distance from the ground bus bar. The method further includes overmolding a second overmolded body over the inner side of the first overmolded body. The second overmolded body encases the intermediate segments of the signal conductors in the second lead frame.

DETAILED DESCRIPTION OF THE INVENTION

Figure 1:
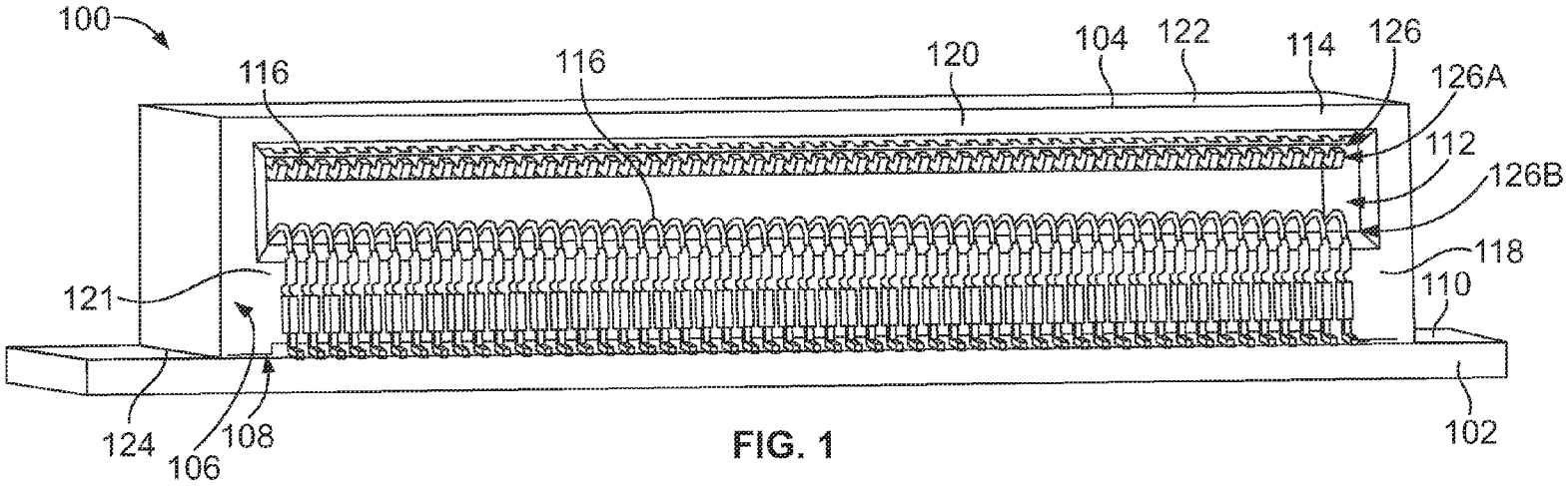
FIG. 1 is a front perspective view of a circuit board assembly according to an embodiment.
Figure 2:
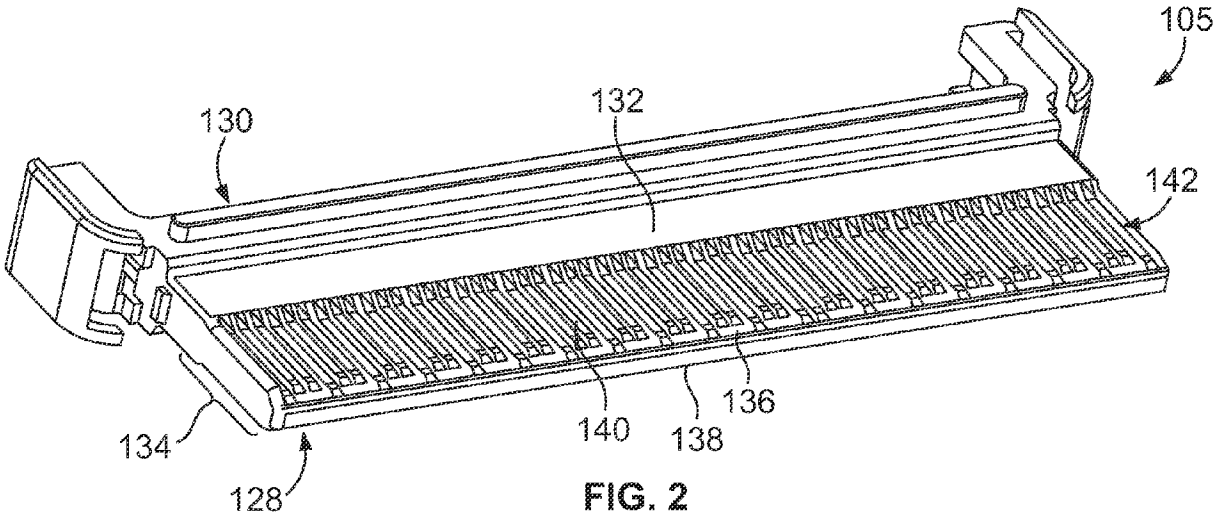
FIG. 2 is a perspective view of a plug electrical connector that is configured to mate to a receptacle electrical connector of the circuit board assembly to define an electrical connector system.

FIG. 1 is a front perspective view of a circuit board assembly 100 according to an embodiment. The circuit board assembly 100 includes a circuit board 102 and an electrical connector 104 mounted to the circuit board 102. FIG. 2 is a perspective view of a mating electrical connector 105 that is configured to mate to the electrical connector 104 of the circuit board assembly 100 to define an electrical connector system. The electrical connector 104 is a receptacle connector and the mating electrical connector 105 is a plug connector, as a portion of the mating electrical connector 105 is configured to be received within a socket defined by the electrical connector 104. The electrical connector 104 is referred to herein as receptacle connector 104, and the mating electrical connector 105 is referred to as plug connector 105, mating connector 105, or mating plug connector 105. The receptacle connector 104 provides an electrically conductive signal path between the circuit board 102 and the mating plug connector 105. The receptacle connector 104 and the plug connector 105 are high speed input-output (I/O) connectors that transmit data signals at speeds over 10 gigabits per second (Gbps), such as over 25 Gbps. The connectors 104, 105 may also be configured to transmit low speed data signals and/or power in addition to transmitting high speed data signals.

The receptacle connector 104 extends between a mating end 106 and a mounting end 108. The mounting end 108 is terminated to a top surface 110 of the circuit board 102. The mating end 106 defines an interface for connecting to the mating connector 105. In the illustrated embodiment, the mating end 106 defines the slot 112 that receives the mating connector 105 therein. The receptacle connector 104 in the illustrated embodiment is a right-angle style connector such that the mating end 106 is oriented generally perpendicular to the mounting end 108. The slot 112 is configured to receive the mating connector 105 in a loading direction that is parallel to the top surface 110 of the circuit board 102. In an alternative embodiment, the connector 104 may be a vertical style connector in which the mating end is generally opposite to the mounting end, and the connector receives the mating connector 105 in a loading direction that is transverse to, such as perpendicular to, the top surface 110. In another alternative embodiment, the receptacle connector 104 may be terminated to an electrical cable instead of to the circuit board 102.

The receptacle connector 104 includes a housing 114. The housing 114 includes a plurality of sides, such as a front side 118, a top side 122, and a bottom side 124. As used herein, relative or spatial terms such as "front," "rear," "first," "second," "left," and "right" are only used to distinguish the referenced elements and do not necessarily require particular positions or orientations in the circuit board assembly 100 or the receptacle connector 104 relative to gravity or to the surrounding environment. The front side 118 defines the mating end 106 of the connector 104, such that the slot 112 extends into the housing 114 through the front side 118. The slot 112 is defined vertically between an upper side wall 120 and a lower side wall 121. The bottom side 124 defines the mounting end 108. The bottom side 124 abuts or at least faces the top surface 110 of the circuit board 102.

The receptacle connector 104 also includes conductors 116 that are held at least partially within the housing 114. The conductors 116 are configured to provide conductive paths through the receptacle connector 104. In an embodiment, the conductors 116 are organized in two arrays 126. The conductors 116 in each respective array 126 are arranged side-by-side in a row. The conductors 116 in a first array 126A extend at least partially into the slot 112 from the upper side wall 120, and the conductors 116 of a second array 126B extend at least partially into the slot 112 from the lower side wall 121.

The mating plug connector 105 extends between a mating end 128 and a terminating end 130. The terminating end 130 of the plug connector 105 may be configured to terminate to an electrical cable (not shown) or, alternatively, to a circuit card or the like. The plug connector 105 includes a plug housing 132 that extends between the ends 128, 130. The plug housing 132 includes a front tray 134 that defines the mating end 128 and extends towards the terminating end 130. The front tray 134 is configured to be loaded into the slot 112 of the receptacle connector 104. The front tray 134 defines a first outer surface 136 and an opposite second outer surface 138. The plug connector 105 includes mating contacts 140 that are exposed on the front tray 134 for engaging corresponding conductors 116 of the receptacle connector 104. An array 142 of mating contacts 140 extends in a planar row on the first outer surface 136. Although not shown, the plug connector 105 includes another array of mating contacts 140 disposed on the second outer surface 138.

During mating, as the front tray 134 of the mating plug connector 105 is received within the slot 112 of the receptacle connector 104, the mating contacts 140 along the first outer surface 136 engage corresponding conductors 116 in the first array 126A that extend from the upper side wall 120, and the mating contacts 140 along the second outer surface 138 engage corresponding conductors 116 in the second array 126B that extend from the lower side wall 121. The conductors 116 may be configured to deflect towards the respective side walls 120, 121 from which the conductors 116 extend in order to exert a biased retention force on the corresponding mating contacts 140 to retain mechanical and electrical contact with the mating contacts 140.

Figure 3:
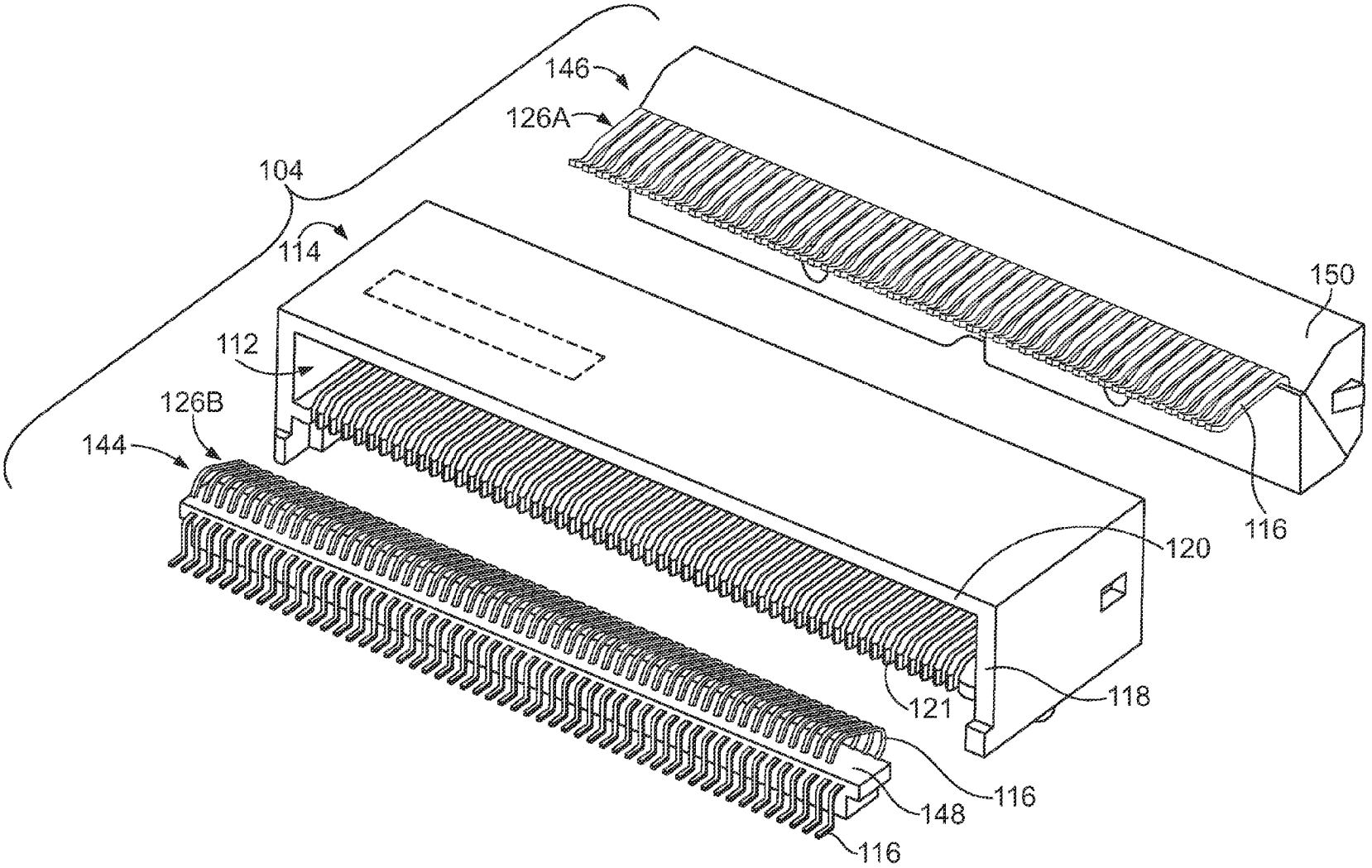
FIG. 3 is a perspective exploded view of the receptacle electrical connector according to an embodiment.

FIG. 3 is a perspective exploded view of the receptacle electrical connector 104 according to an embodiment. The receptacle connector 104 includes the housing 114, a front connector sub-assembly 144, and a rear connector sub-assembly 146. The front and rear connector sub-assemblies 144, 146 are configured to be received within the housing 114 and secured to the housing 114 to assemble the receptacle connector 104. The front and rear connector sub-assemblies 144, 146 hold the conductors 116 of the receptacle connector 104. For example, the front connector sub-assembly 144 contains the second array 126B of conductors 116 that extends into the slot 112 from the lower side wall 121 of the housing 114 (as shown in FIG. 1). The rear connector sub-assembly 146 contains the first array 126A of conductors 116 that extends into the slot 112 from the upper side wall 120.

The front connector sub-assembly 144 includes a front dielectric carrier 148 that encases segments of the conductors 116 that are in the second array 126B to secure the positioning and orientation of the conductors 116. The front dielectric carrier 148 is composed of a dielectric material that includes one or more plastics or other polymers. The front dielectric carrier 148 extends between the conductors 116 to electrically isolate the conductors 116 in the second array 126B from one another. The dielectric carrier 148 may be overmolded in a single step over the conductors 116, a process referred to herein as a single-shot overmold. In an embodiment, the front connector sub-assembly 144 is configured to convey low speed data signals, control signals, and/or power, but not high speed data signals. Since the signal-transmitting conductors 116 are not configured to convey high speed data signals, in an embodiment the conductors 116 that provide grounding and shielding between the signal-transmitting conductors 116 are not electrically commoned via a ground tie bar. In an alternative embodiment, the front connector sub-assembly 144 may be configured to transmit high speed data signals, and the conductors 116 that provide grounding optionally may be electrically commoned via a ground tie bar.

The rear connector sub-assembly 146 includes a rear dielectric carrier 150 that encases segments of the conductors 116 in the first array 126A to secure the positioning and orientation of the conductors 116. Like the front dielectric carrier 148, the rear dielectric carrier 150 is composed of a dielectric material that includes one of more plastics or other polymers. The rear dielectric carrier 150 electrically isolates the conductors 116 in the first array 126A from one another. In an exemplary embodiment, the rear dielectric carrier 150 is formed in a two-step overmolding process that involves two separate overmolding steps, as described in more detail herein. The dielectric carrier 150 is configured to convey high speed data signals, but also may be used to convey low speed data signals, control signals, and/or power. As described herein, the rear connector sub-assembly 146 includes a ground bus bar 200 (shown in FIG. 5) that electrically commons the conductors 116 that provide grounding and shielding for the signal-transmitting conductors 116. The ground bus bar 200 is encased within the dielectric carrier 150.

The front connector sub-assembly 144 is referred to as "front" while the rear connector sub-assembly 146 is referred to as "rear" because the front dielectric carrier 148 is frontward of the rear dielectric carrier 150 (for example, more proximate to the front side 118 of the housing 114) when both the connector sub-assemblies 144, 146 are received within the housing 114.

Figure 4:
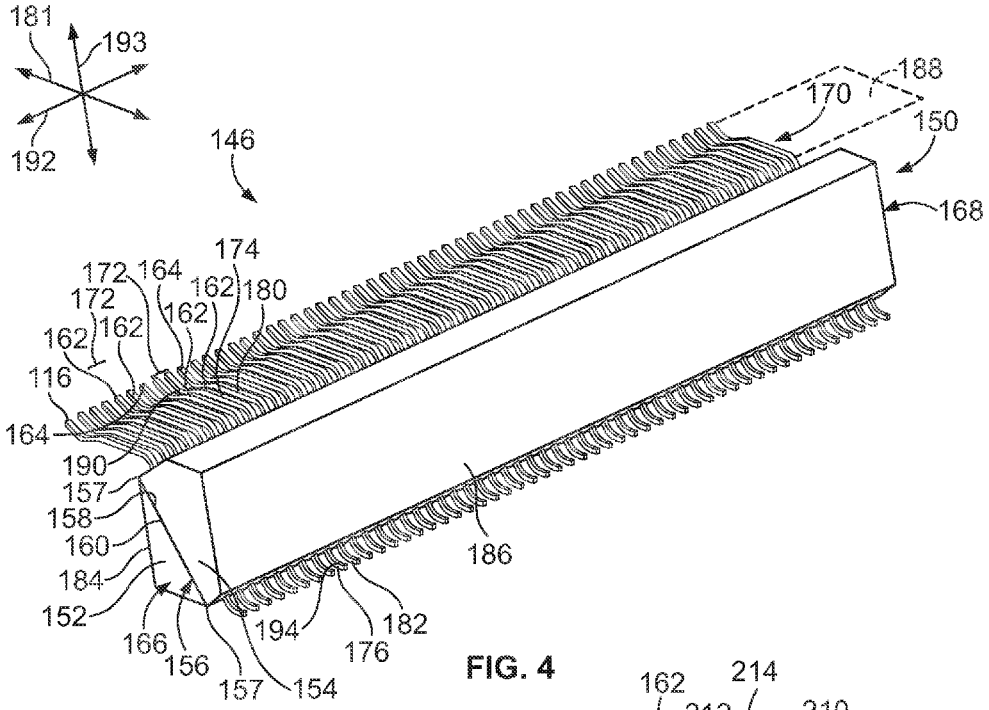
FIG. 4 is a rear perspective view of a connector sub-assembly of the receptacle electrical connector according to an embodiment.

FIG. 4 is a rear perspective view of the rear connector sub-assembly 146 according to an embodiment. The connector sub-assembly 146 is oriented with respect to a longitudinal 191, the lateral axis 192, and a vertical or elevation axis 193. The axes 191-193 are mutually perpendicular. Although the elevation axis 193 appears to extend in a vertical direction parallel to gravity, it is understood that the axes 191-193 are not required to have any particular orientation with respect to gravity.

The dielectric carrier 150 of the rear connector sub-assembly 146 is defined by a first overmolded body 152 and a second overmolded body 154 that engage one another at an overmold interface 156. For example, the first overmolded body 152 has a respective inner side 158, and the second overmolded body 154 also has a respective inner side 160. The inner side 160 of the second overmolded body 154 engages the inner side 158 of the first overmolded body 152 at the overmold interface 156. As described further herein, in an exemplary embodiment, the second overmolded body 154 is formed in-situ on the inner side 158 of the first overmolded body 152. As such, the inner side 160 of the second overmolded body 154 is at least partially defined by a profile of the inner side 158 of the first overmolded body 152.

The first and second overmolded bodies 152, 154 have parallelepiped (or prismatic) structures that each defines a polygonal cross-sectional shape having at least three sides. The dielectric carrier 150 defined by the first and second overmolded bodies 152, 154 has a parallelepiped structure that defines a polygonal cross-sectional shape having at least four outer sides. For example, the first overmolded body 152 in the illustrated embodiment is a triangular prism such that the first overmolded body 152 has a generally triangular cross-sectional shape with three sides, including the inner side 158. The second overmolded body 154 in the illustrated embodiment is a prism that has a pentagonal cross-sectional shape with five sides, including the inner side 160. The cross-sectional shape of the dielectric carrier 150 in the illustrated embodiment includes six outer sides. The first overmolded body 152, the second overmolded body 154, and/or the dielectric carrier 150 defined by the first and second overmolded bodies 152, 154 may have different cross-sectional shapes in other embodiments. The overmold interface 156 extends between two opposite corners 157 of the dielectric carrier 150. The term "opposite corners" refers to two corners (at intersections between adjacent outer sides) that are not adjacent to one another along a perimeter of the dielectric carrier 150.

The conductors 116 of the connector sub-assembly 146 include signal conductors 162 and ground conductors 164. The signal and ground conductors 162, 164 are arranged in a row 170 across a length of the dielectric carrier 150 between opposite first and second ends 166, 168 of the dielectric carrier 150. The signal conductors 162 and the ground conductors 164 are organized in a repeating ground-signal-signal-ground (GSSG) pattern along the row 170. For example, the signal conductors 162 are arranged in pairs 172, and the ground conductors 164 are interleaved between the pairs 172 of signal conductors 162. One ground conductor 164 is disposed between two adjacent pairs 172 of signal conductors 162 in the illustrated embodiment, but two or more ground conductors 164 may separate pairs 172 of signal conductors 162 in other embodiments. The pairs 172 of signal conductors 162 may be utilized to convey high speed differential signals. Optionally, some of the signal conductors 162 may be selectively utilized as single-ended conductors to convey low speed data signals, control signals, or power.

Each of the signal conductors 162 defines a mating signal contact 174, a terminating signal contact 176, and an intermediate segment 178 (shown in FIG. 5) between the mating signal contact 174 and the terminating signal contact 176 along the length of the respective conductor 162. The intermediate segments 178 are encased within the dielectric carrier 150. For example, the signal conductors 162 along the intermediate segments 178 are fully surrounded by and engaged by the dielectric material of the dielectric carrier 150. The mating signal contacts 174 and the terminating signal contacts 176 extend outward from the dielectric carrier 150.

The mating signal contacts 174 extend generally frontward relative to a front-facing side 184 of the dielectric carrier 150. The mating signal contacts 174 may each extend parallel to the longitudinal axis 191. The front tray 134 (shown in FIG. 2) of the mating plug connector 105 (FIG. 2) is loaded into the slot 112 (FIG. 1) of the receptacle connector 104 (FIG. 1) in a loading direction along the longitudinal axis 191. The mating signal contacts 174 include curved engagement features 190 that are configured to engage corresponding mating contacts 140 (shown in FIG. 2) of the mating plug connector 105 (FIG. 2). The mating signal contacts 174 across the row 170 may align with one another along a contact plane 188. For example, the mating signal contacts 174 may align with one another along the vertical axis 193 and the longitudinal or mating axis 191, although the mating signal contacts 174 are spaced apart along the lateral axis 192.

The terminating signal contacts 176 extend generally rearward relative to a rear-facing side 186 of the dielectric carrier 150. The terminating signal contacts 176 also extend generally downward in order for tails 194 of the terminating signal contacts 176 to engage and electrically connect to the circuit board 102 (shown in FIG. 1). In the illustrated embodiment, the tails 194 are solder tails that extend generally parallel to the top surface 110 (FIG. 1) of the circuit board 102 for surface mounting to conductive pads (not shown). But, in an alternative embodiment, the tails 194 may be pins that are configured to be through-hole mounted within conductive vias (not shown) of the circuit board 102. The terminating signal contacts 176 across the row 170 may extend parallel to one another and may align with one another similar to the mating signal contacts 174.

Figure 5:
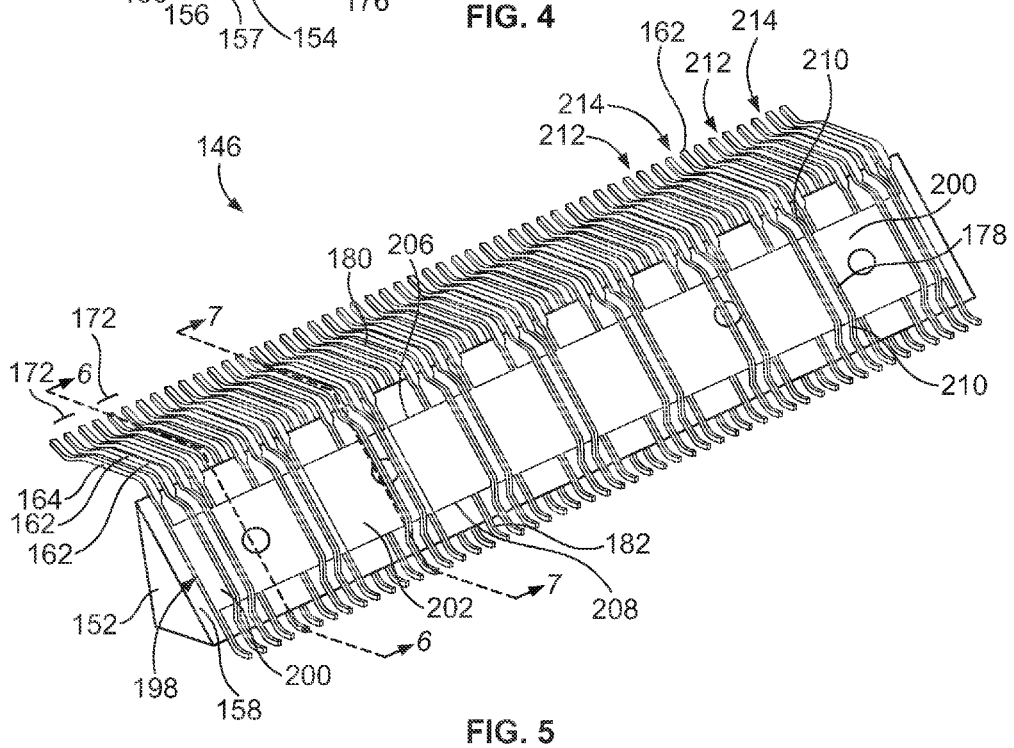
FIG. 5 is a rear perspective view of the connector sub-assembly of FIG. 4 omitting a second overmolded body.

The ground conductors 164 in an embodiment are all portions of a ground frame 198 (shown in FIG. 5). The ground frame 198 also includes a ground bus bar 200 (shown in FIG. 5) that is encased within the dielectric carrier 150. The ground conductors 164 include mating ground contacts 180 and terminating ground contacts 182 that extend from the dielectric carrier 150 to provide shielding between the mating signal contacts 174 and the terminating signal contacts 176, respectively. For example, the mating ground contacts 180 may align with the mating signal contacts 174 in the contact plane 188 defined by the mating signal contacts 174 along the row 170. Similarly, the terminating ground contacts 182 may align with the terminating signal contacts 176. The mating ground contacts 180 and the terminating ground contacts 182 optionally have the same sizes and/or shapes as the respective mating signal contacts 174 and terminating signal contacts 176.

FIG. 5 is a rear perspective view of the rear connector sub-assembly 146 omitting the second overmolded body 154 (shown in FIG. 4). Since the second overmolded body 154 is not shown, the ground frame 198 of the connector sub-assembly 146 is visible. The ground frame 198 is disposed on the inner side 158 of the first overmolded body 152. The ground frame 198 includes the ground bus bar 200. The ground conductors 164 extend from the ground bus bar 200. The ground conductors 164 are all joined to the ground bus bar 200, such that all of the ground conductors 164 are electrically commoned via the ground bus bar 200. The ground bus bar 200 extends laterally (for example, along the lateral axis 192 shown in FIG. 4) across the signal conductors 162. The ground conductors 164 are spaced apart along the lateral length of the ground bus bar 200. The ground bus bar 200 in an embodiment is planar. For example, the ground bus bar 200 may define a top (broad) side 202 and an opposite bottom (broad) side 204 (shown in FIG. 6). The bottom side 204 engages the inner side 158 of the first overmolded body 152. The top side 202 engages and at least partially defines the inner side 160 (shown in FIG. 6) of the second overmolded body 154, since the second overmolded body 154 is formed over the inner side 158 and the ground frame 198 disposed thereon.

The ground bus bar 200 also includes a front edge side 206 and a rear edge side 208. The mating ground contacts 180 extend from the front edge side 206, and the terminating ground contacts 182 extend from the rear edge side 208. The portions of the mating ground contacts 180 and the portions of the terminating ground contacts 182 that extend along the inner side 158 may be co-planar with the ground bus bar 200. Further, the portions of the mating ground contacts 180 and the portions of the terminating ground contacts 182 outside of the inner side 158 may be bent or otherwise formed to extend out of the plane defined by the ground bus bar 200.

In an embodiment, the ground frame 198 is formed as a unitary structure, such that the ground conductors 164 are integral to the ground bus bar 200. The ground frame 198 may be composed of one or more metals, such as copper, silver, or an alloy including copper and/or silver, or may be formed of an electrically lossy dielectric material containing metal particles dispersed therein. The ground frame 198 may be stamped and formed from a metal panel or sheet.

Figure 6:
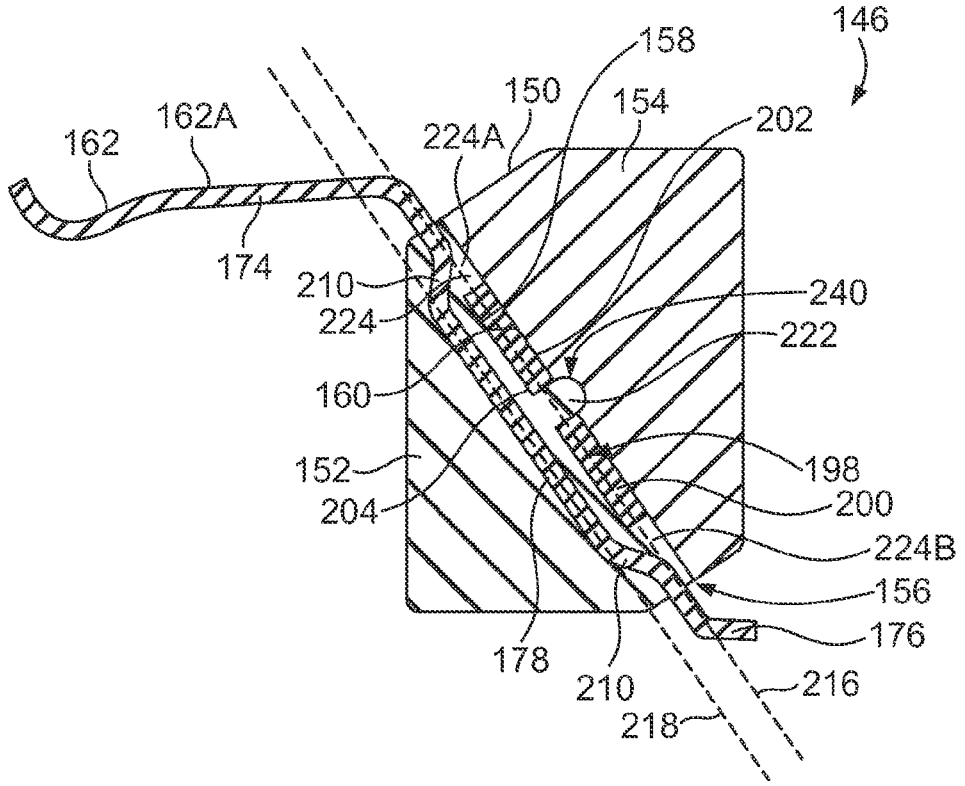
FIG. 6 is a cross-sectional view of the connector sub-assembly taken along the line 6-6 shown in FIG. 5.
Figure 7:
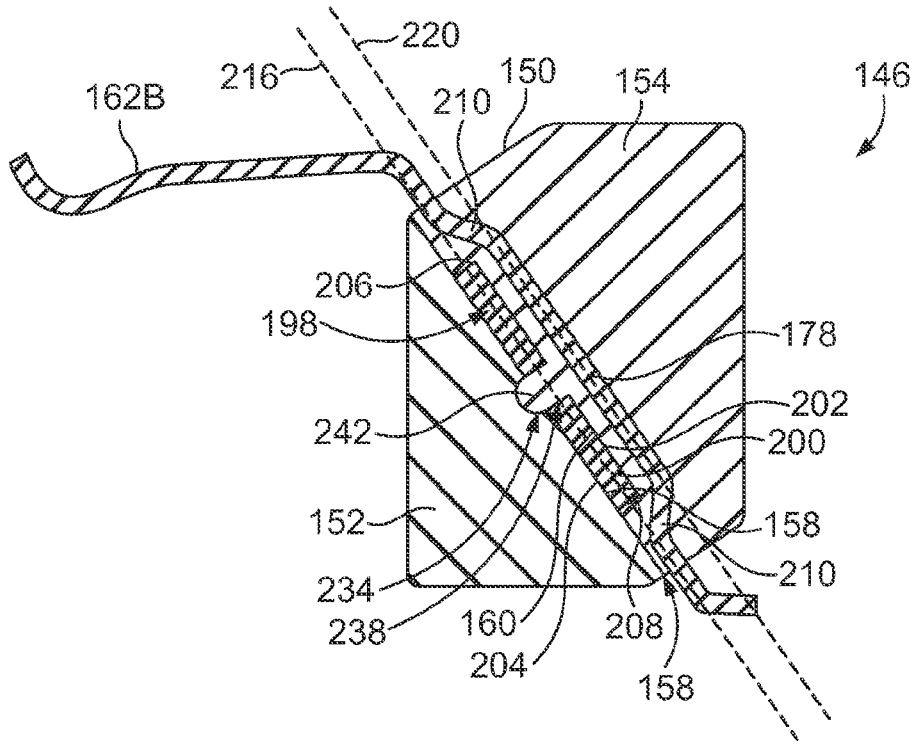
FIG. 7 is a cross-sectional view of the connector sub-assembly taken along the line 7-7 shown in FIG. 5.

As shown in cross-section in FIGS. 6 and 7, the intermediate segments 178 of some of the signal conductors 162 are encased in the first overmolded body 152, and the intermediate segments 178 of the other signal conductors 162 are encased in the second overmolded body 154 (shown in FIG. 4). Since the second overmolded body 154 is not shown in FIG. 5, the intermediate segments 178 of the corresponding signal conductors 162 that are encased within the second overmolded body 154 are visible. The intermediate segments 178 of the corresponding signal conductors 162 encased within the first overmolded body 152 are not visible in FIG. 5 as such intermediate segments 178 are submerged below the inner side 158. The intermediate segments 178 encased in the second overmolded body 154 extend above the top side 202 of the ground bus bar 200. The intermediate segments 178 encased in the first overmolded body 152 extend below the bottom side 204 (shown in FIG. 6) of the ground bus bar 200. In an embodiment, the intermediate segments 178 of the signal conductors 162 include S-curve portions 210 that jog the respective intermediate segments 178 to extend around the ground bus bar 200 without engaging the ground bus bar 200.

In the illustrated embodiment, the intermediate segments 178 of the signal conductors 162 in a respective pair 172 of signal conductors 162 are encased in the first overmolded body 152, and the intermediate segments 178 of the pair 172 of signal conductors 162 adjacent to the respective pair 172 are encased in the second overmolded body 154 (shown in FIG. 4). Thus, the pairs 172 of signal conductors 162 along the length of the row are jogged in generally opposite directions. In an embodiment, the signal conductors 162 are arranged in two different sets. The signal conductors 162 in a first set form part of a first lead frame 212, and the signal conductors 162 in the second set form part of a second lead frame 214. Each of the first and second lead frames includes respective signal conductors 162 defining leads that are joined, at one time, to carrier strips that hold the leads of the respective lead frame together. The carrier strips are shown in FIGS. 10-13. In an embodiment, the signal conductors 162 of the first set that form part of the first lead frame 212 are the signal conductors 162 with intermediate segments 178 encased in the first overmolded body 152. The signal conductors 162 of a second set that form part of the second lead frame 214 are the signal conductors 162 with intermediate segments 178 encased in the second overmolded body 154. The signal conductors 162 of the first set are jogged in an opposite direction relative to the signal conductors 162 of the second set.

FIG. 6 is a cross-sectional view of the rear connector sub-assembly 146 taken along the line 6-6 shown in FIG. 5. FIG. 7 is a cross-sectional view of the rear connector sub-assembly 146 taken along the line 7-7 shown in FIG. 5. The second overmolded body 154 is shown in both FIGS. 6 and 7. The ground bus bar 200 is encased in the dielectric carrier 150. In an embodiment, the ground bus bar 200 is held at the overmold interface 156 between the inner side 158 of the first overmolded body 152 and the inner side 160 of the second overmolded body 154. For example, the bottom side 204 of the ground bus bar 200 engages the inner side 158 of the first overmolded body 152, and the top side 202 engages the inner side 160 of the second overmolded body 154. The second overmolded body 154 is partially defined by the inner side 158 of the first overmolded body 152 and partially defined by the ground bus bar 200, such that the inner side 160 engages and forms on the top side 202 of the ground bus bar 200. The inner side 158 directly engages the inner side 160 at least at sections that border the ground bus bar 200, as described in more detail herein. In an alternative embodiment, the ground bus bar 200 is encased in the first overmolded body 152 and does not extend into the overmold interface 156. In such alternative embodiment, the inner side 158 of the first overmolded body 152 defines the entirety (or at least most) of the inner side 160 of the second overmolded body 154, and the ground bus bar 200 does not define the inner side 160.

The overmold interface 156 defines an interface plane 216. In an embodiment, the intermediate segments 178 of the signal conductors 162 are jogged to extend along two different encasement planes parallel to the interface plane 216 within the different first and second overmolded bodies 152, 154 of the dielectric carrier 150. The intermediate segments 178 of some of the signal conductors 162 extend along a first encasement plane 218 within the first overmolded body 152. The intermediate segments 178 of the other signal conductors 162 of the connector sub-assembly 146 extend along a second encasement plane 220 within the second overmolded body 154. The first and second encasement planes 218, 220 are spaced apart from the interface plane 216.

The cross-section shown in FIG. 6 extends through a signal conductor 162A that has an intermediate segment 178 that is encased in the first overmolded body 152. The signal conductor 162A is one of the signal conductors 162 of the first lead frame 212 (shown in FIG. 5). The intermediate segment 178 is jogged through the S-curve portions 210 to extend below the ground bus bar 200 along the first encasement plane 218. The signal conductor 162A is spaced apart from the bottom side 204 of the ground bus bar 200 and does not engage the ground bus bar 200. As shown in FIG. 6, if the signal conductor 162A is not jogged, the intermediate segment 178 would contact the ground bus bar 200, which would electrically short the signal conductor 162A. In an embodiment, the intermediate segments 178 of the conductors 162 of the first lead frame 212 are all jogged to extend along the first encasement plane 218.

The cross-section shown in FIG. 7 extends through a signal conductor 162B that has an intermediate segment 178 that is encased in the second overmolded body 154. The signal conductor 162B is one of the signal conductors 162 of the second lead frame 214 (shown in FIG. 5). The intermediate segment 178 is jogged through the S-curve portions 210 to extend above the ground bus bar 200 along the second encasement plane 220. The signal conductor 162B is spaced apart from the top side 202 of the ground bus bar 200 and does not engage the ground bus bar 200. The intermediate segments 178 of the conductors 162 of the second lead frame 214 may all be jogged to extend along the second encasement plane 220.

As described above, in an exemplary embodiment the second overmolded body 154 is formed in-situ on the inner side 158 of the first overmolded body 152. For example, the second overmolded body 154 may be formed over the components shown in FIG. 5, including the ground frame 198 disposed on the inner side 158 and the intermediate segments 178 of the signal conductors 162 of the second lead frame 214 (shown in FIG. 5). The second overmolded body 154 is formed via an overmolding process. The inner side 160 of the second overmolded body 154 at the overmold interface 156 is partially defined by a profile of the inner side 158 of the first overmolded body 152 and is partially defined by the ground frame 198. Therefore, contours of the inner side 160 of the second overmolded body 154 are defined directly by the shape and surface topology of the ground frame 198 and the profile of the inner side 158. The second overmolded body 154 encases the intermediate segments 178 of the signal conductors 162 of the second lead frame 214 as the second overmolded body 154 is formed on the inner side 158. The second overmolded body 154 forms around protrusions and/or within depressions located along the ground bus bar 200 and/or the inner side 158 of the first overmolded body 152.

Figure 8:
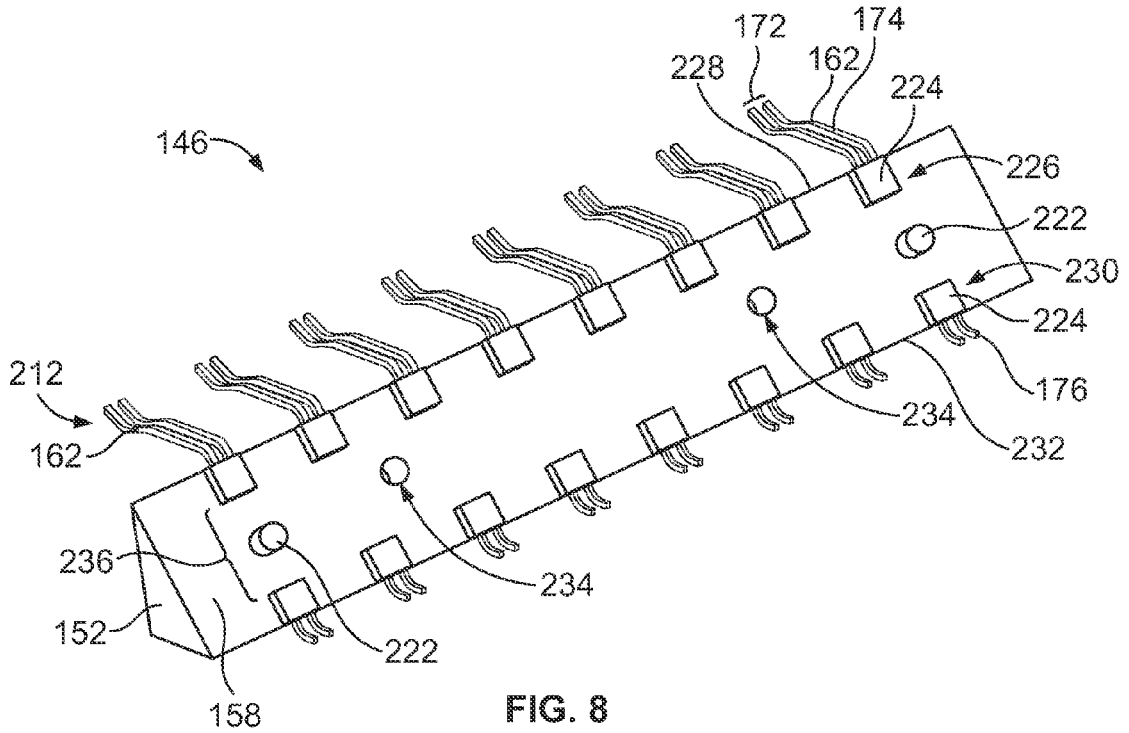
FIG. 8 is a perspective view of the connector sub-assembly in a partially-assembled state according to an embodiment.

Reference is now made to FIG. 8, which is a perspective view of the connector sub-assembly 146 in a partially-assembled state according to an embodiment. The first overmolded body 152 is formed around and encases the signal conductors 162 of the first lead frame 212. For example, the first overmolded body 152 is overmolded around the first lead frame 212. In an embodiment, the first overmolded body 152 includes one or more protrusions that extend outward from the inner side 158. In the illustrated embodiment, the protrusions of the overmolded body 152 are two posts 222 and multiple lugs 224. The lugs 224 are arranged in a first row 226 along a top edge 228 of the inner side 158 and in a second row 230 along a bottom edge 232 of the inner side 158. The lugs 224 align with the pairs 172 of signal conductors 162. With additional reference to FIG. 6, the mating signal contact 174 of the signal conductor 162A extends from the dielectric carrier 150 through a corresponding first-row lug 224A (that aligns in the first row 226). The terminating signal contact 176 of the signal conductor 162A extends from the dielectric carrier 150 through a corresponding second-row lug 224B (that aligns in the second row 230).

Referring now solely to FIG. 8, the posts 222 are disposed in a channel 236 defined between the first and second rows 226, 230 of the lugs 224. The first overmolded body 152 also defines at least one depression that extends inward (into the overmolded body 152) from the inner side 158. In the illustrated embodiment, the depressions are two cavities 234 that are disposed in the channel 236 between the first and second rows 226, 230 of the lugs 224. In other embodiments, the protrusions and/or the depressions along the inner side 158 may have other respective shapes, numbers, and/or arrangements. For example, in another embodiment the inner side 158 may include a periodic surface topology that includes parallel undulating valleys and peaks. The periodic surface topology may support securing the second overmolded body 154 to the first overmolded body 152 when the second overmolded body 154 forms to the periodic surface topology.

Figure 9:
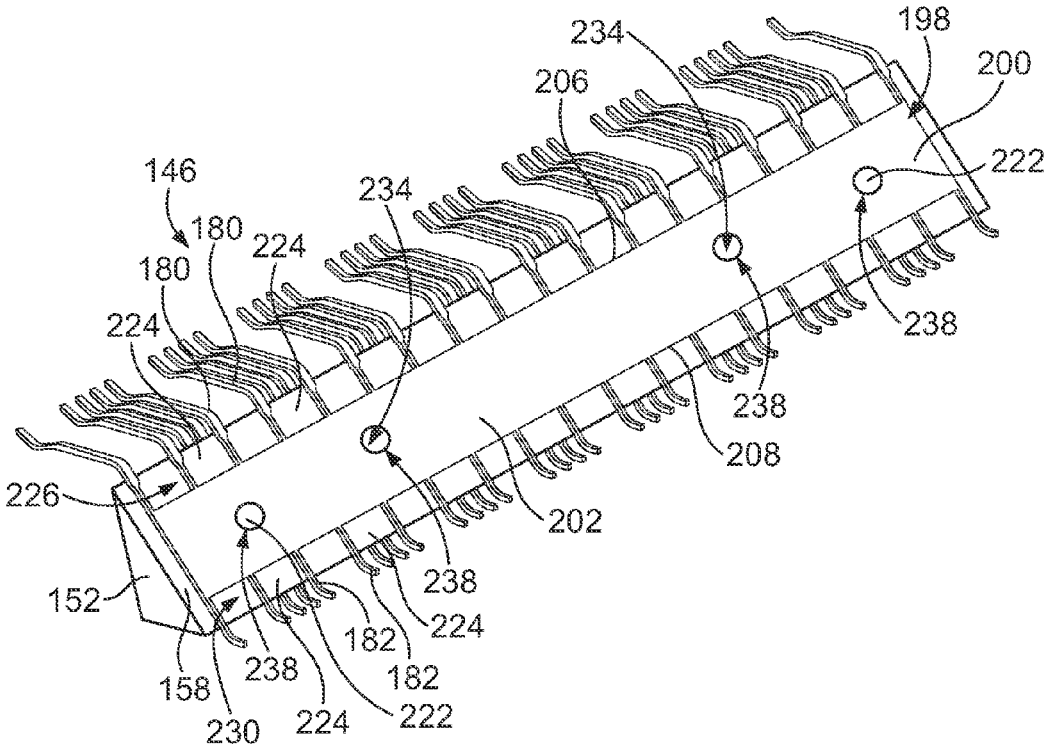
FIG. 9 is a perspective view of the connector sub-assembly in another partially-assembled state according to an embodiment.

FIG. 9 is a perspective view of the connector sub-assembly 146 in another partially-assembled state according to an embodiment. FIG. 9 shows the ground frame 198 mounted to the inner side 158 of the first overmolded body 152. The ground bus bar 200 is disposed in the channel 236 (shown in FIG. 8) between the first and second rows 226, 230 of the lugs 224. The first and second rows 226, 230 of lugs 224 may respectively engage the front and rear edge sides 206, 208 of the ground bus bar 200 to secure the ground frame 198 on the inner side 158. The mating ground contacts 180 extend between the lugs 224 in the first row 226, and the terminating ground contacts 182 extend between the lugs 224 in the second row 230. The ground bus bar 200 defines multiple apertures 238 that extend through the bus bar 200. The apertures 238 are configured to align with the posts 222 and the cavities 234 of the inner side 158 of the first overmolded body 152. The posts 222 extend fully through the corresponding apertures 238 such that the posts 222 extend beyond the top side 202 of the ground bus bar 200.

Referring now back to FIGS. 6 and 7, as the second overmolded body 154 is formed over the inner side 158 and the ground frame 198 disposed thereon, the second overmolded body 154 forms around the posts 222 and the lugs 224, and extends through the apertures 238 of the ground bus bar 200 to at least partially fill the cavities 234 in the first overmolded body 152. As shown in FIG. 6 specifically, the second overmolded body 154 forms around the lugs 224 that border the ground bus bar 200. The second overmolded body 154 also forms around the post 222, which defines a corresponding depression 240 in the inner side 160 of the second overmolded body 154. With specific reference to FIG. 7, the second overmolded body 154 forms around the front and rear edge sides 206, 208 of the ground bus bar 200. The second overmolded body 154 also extends through the aperture 238 of the ground bus bar 200 to fill the cavity 234 defined along the inner side 158 of the first overmolded body 152. The dielectric material that fills the cavity 234 defines a corresponding protrusion 242 that extends from the inner side 160 of the second overmolded body 154.

Therefore, as shown in FIGS. 6 and 7, the inner side 160 of the second overmolded body 154 is defined by both the profile of the inner side 158 of the first overmolded body 152, including protrusions and depressions defined along the inner side 158, and the shape and surface topology of the ground frame 198 (especially of the ground bus bar 200). For example, since the depression 240 shown in FIG. 6 along the inner side 160 of the second overmolded body 154 is defined by the post 222 of the first overmolded body 152, a substantial entirety of an inner surface of the depression 240 engages a perimeter surface of the post 222. Similarly, a substantial entirety of a perimeter surface of the protrusion 242 of the second overmolded body 154 shown in FIG. 7 engages an inner surface of the cavity 234 of the first overmolded body 152. Due to the overmolding process that produces such engaging features, the tolerances and clearances between the first and second overmolded bodies 152, 154 may be less than if the first and second overmolded bodies 152, 154 are both formed separately and joined using fasteners and/or adhesives. As a result of the better fit allowed by two-shot overmolding, the connector sub-assembly 146 may have increased structural integrity and may provide better signal integrity than known electrical connector sub-assemblies that are not produced by two-shot overmolding.

Figure 10:
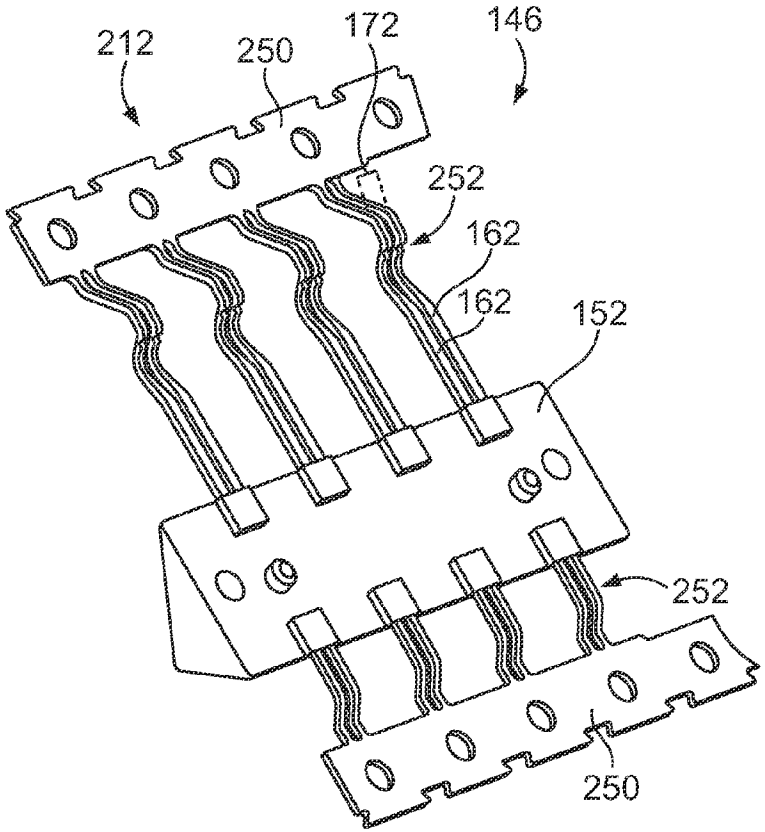
FIG. 10 is a perspective view of the connector sub-assembly in one stage of an assembly process according to an embodiment.

FIGS. 10-13 are perspective views of the connector sub-assembly 146 in various stages of an assembly or production process according to an embodiment. In FIG. 10, the signal conductors 162 of the first lead frame 212 are overmolded in the first overmolded body 152. The first lead frame 212 includes a respective carrier strip 250 at distal ends 252 of the conductors 162. The carrier strips 250 may be used to retain the positioning of the conductors 162 prior to being overmolded in the first overmolded body 152. The signal conductors 162 are arranged in pairs 172. Adjacent pairs 172 are spaced apart from one another along a length of the first overmolded body 152.

Figure 11:
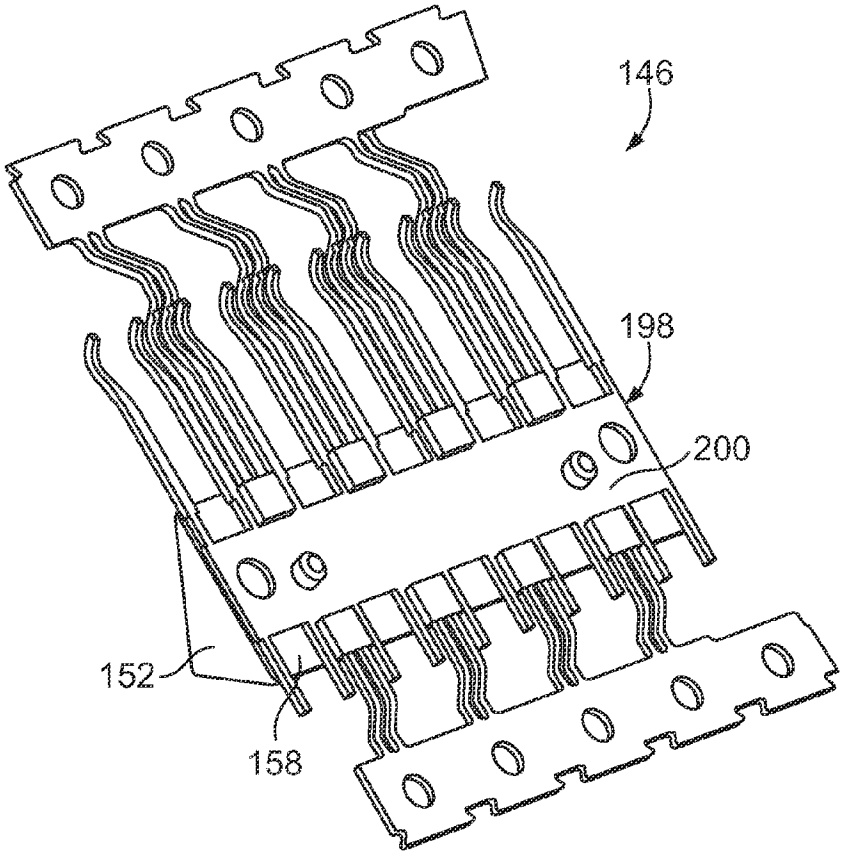
FIG. 11 is a perspective view of the connector sub-assembly in another stage of the assembly process.
Figure 13:
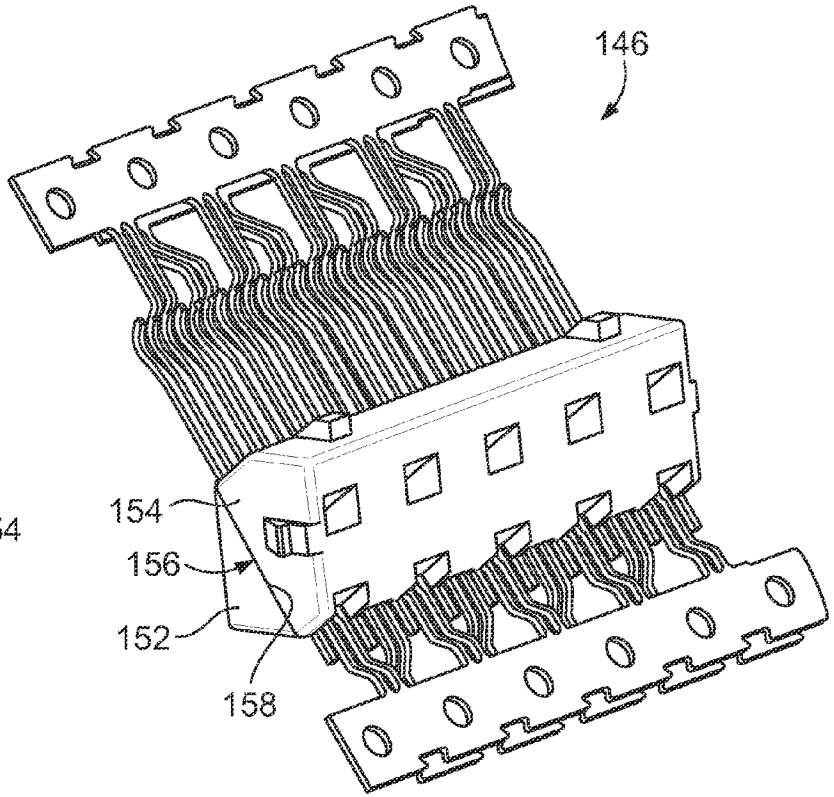
FIG. 13 is a perspective view of the connector sub-assembly in yet another stage of the assembly process.
Figure 12:
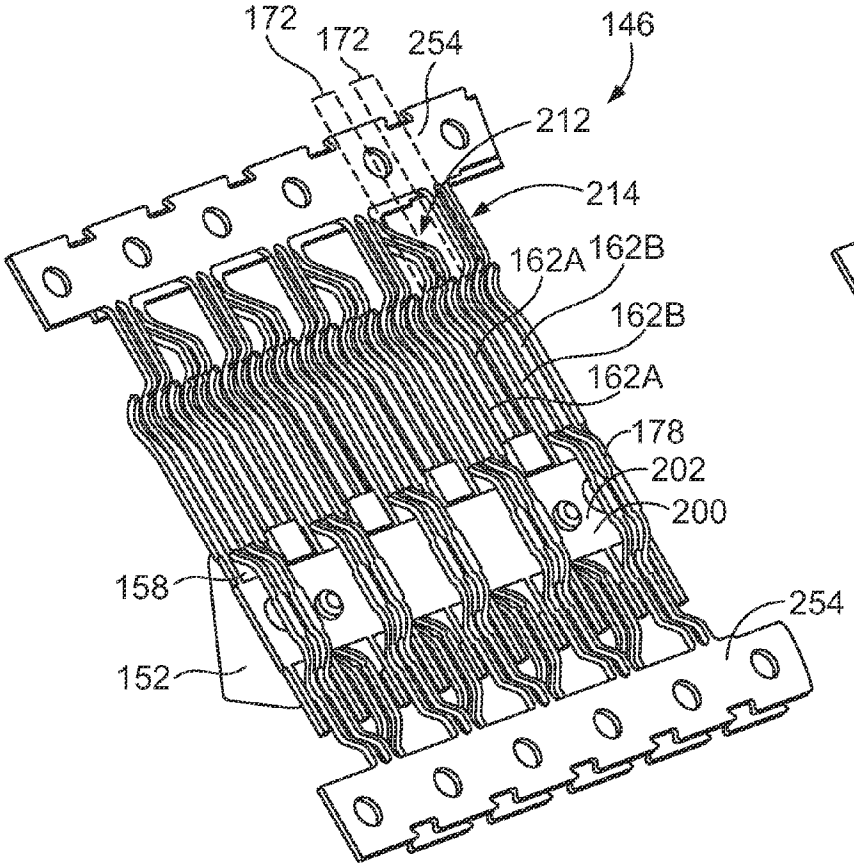
FIG. 12 is a perspective view of the connector sub-assembly in yet another stage of the assembly process.

In FIG. 11, the ground frame 198 is mounted on the inner side 158 of the first overmolded body 152. The bottom side 204 (shown in FIG. 6) of the ground bus bar 200 of the ground frame 198 engages the inner side 158. In FIG. 12, the signal conductors 162B of the second lead frame 214 are positioned along the inner side 158 of the first overmolded body 152. The second lead frame 214 includes the signal conductors 162B and respective carrier strips 254 that retain the relative positions of the signal conductors 162B until the conductors 162B are encased in the second overmolded body 154. The intermediate segments 178 of the signal conductors 162B are jogged around the top side 202 of the ground bus bar 200, such that the signal conductors 162B are separated by a distance from the ground bus bar 200. The signal conductors 162B in the second lead frame 214 are arranged in pairs 172 that are each disposed laterally between adjacent pairs 172 of the signal conductors 162A in the first lead frame 212. In FIG. 13, the second overmolded body 154 is overmolded on the inner side 158 of the first overmolded body 152. The second overmolded body 154 encases the intermediate segments 178 of the signal conductors 162B in the second lead frame 214. The second overmolding step bonds the first and second overmolded bodies 152, 154 to one another at the overmold interface 156. Optionally, the first and second overmolded bodies 152, 154 may be composed of the same dielectric material. Alternatively, the first overmolded body 152 is composed of a different material than the second overmolded body 154. In a later stage, the carrier strips 250, 254 may be removed from the respective conductors 162 to yield the connector sub-assembly 146 as shown in FIG. 4.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A connector sub-assembly for an electrical connector, comprising:

a dielectric carrier defined by first and second overmolded bodies, the first and second overmolded bodies having respective inner sides that engage one another at an overmold interface;

plural signal conductors arranged in a row, each of the signal conductors defining a mating signal contact, a terminating signal contact, and an intermediate segment therebetween, the intermediate segments being encased within the dielectric carrier, the mating signal contacts and the terminating signal contacts extending from the dielectric carrier; and a ground frame including a ground bus bar and plural ground conductors joined to and extending from the ground bus bar, the ground bus bar extending across the signal conductors and being encased within the dielectric carrier, the ground conductors defining mating ground contacts and terminating ground contacts that extend from the dielectric carrier to provide shielding between the mating signal contacts and the terminating signal contacts, respectively, wherein the second overmolded body is formed in-situ on the inner side of the first overmolded body, the inner side of the second overmolded body at the overmold interface being at least partially defined by a profile of the inner side of the first overmolded body.

2. The connector sub-assembly of claim 1, wherein the intermediate segments of some of the signal conductors are encased in the first overmolded body and the intermediate segments of the other signal conductors of the connector sub-assembly are encased in the second overmolded body.

3. The connector sub-assembly of claim 2, wherein the signal conductors are arranged in pairs along a length of the dielectric carrier, the intermediate segments of a respective pair of signal conductors being encased in the first overmolded body, the intermediate segments of the adjacent pair of signal conductors being encased in the second overmolded body.

4. The connector sub-assembly of claim 1, wherein the first overmolded body includes one or more protrusions that extend outward from the inner side of the first overmolded body, the second overmolded body forming around the one or more protrusions to define one or more corresponding depressions in the inner side of the second overmolded body.

5. The connector sub-assembly of claim 4, wherein the ground bus bar is held between the first and second overmolded bodies at the overmold interface, the ground bus bar defining at least one aperture that extends through the ground bus bar, the at least one aperture receiving a corresponding protrusion of the first overmolded body therethrough.

6. The connector sub-assembly of claim 1, wherein the first overmolded body includes one or more depressions that extend inward from the inner side of the first overmolded body, the second overmolded body filling the one or more depressions to define one or more corresponding protrusions extending outward from the inner side of the second overmolded body.

7. The connector sub-assembly of claim 1, wherein the ground bus bar of the ground frame is planar and defines opposite top and bottom sides, the ground bus bar held between the first and second overmolded bodies at the overmold interface such that the bottom side engages the inner side of the first overmolded body and the top side engages and at least partially defines a profile of the inner side of the second overmolded body.

8. The connector sub-assembly of claim 1, wherein the first overmolded body and the second overmolded body are composed of the same dielectric material.

9. The connector sub-assembly of claim 1, wherein the first overmolded body has a generally triangular cross-sectional shape, the dielectric carrier defined by the first and second overmolded bodies having a polygonal cross-sectional shape defining at least four outer sides, the overmold interface extending between opposite corners of the dielectric carrier.

10. The connector sub-assembly of claim 1, wherein the overmold interface defines an interface plane, the ground bus bar extending along the interface plane between the first and second overmolded bodies, the intermediate segments of the signal conductors being jogged to extend along two different encasement planes parallel to the interface plane within the different first and second overmolded bodies of the dielectric carrier, the intermediate segments of some of the signal conductors extending along a first of the two encasement planes within the first overmolded body, the intermediate segments of the other signal conductors of the connector sub-assembly extending along a second of the two encasement planes within the second overmolded body.

11. The connector sub-assembly of claim 1, wherein the first overmolded body includes lugs that extend outward from the inner side of the first overmolded body, the lugs arranged in a first row along a top edge of the inner side and in a second row along a bottom edge of the inner side, the ground bus bar being held between the first and second overmolded bodies at the overmold interface between the first row of lugs and the second row of lugs.

12. The connector sub-assembly of claim 11, wherein the intermediate segments of some of the signal conductors are encased in the first overmolded body, the mating signal contacts of the signal conductors that are encased in the first overmolded body extending from the dielectric carrier through the lugs in the first row, the terminating signal contacts of the signal conductors that are encased in the first overmolded body extending from the dielectric carrier through the lugs in the second TOW.

13. A connector sub-assembly for an electrical connector, comprising:

first and second overmolded bodies having respective inner sides that engage one another at an overmold interface;

plural signal conductors arranged in a row, each of the signal conductors defining a mating signal contact, a terminating signal contact, and an intermediate segment therebetween, a first set of the signal conductors forming part of a first lead frame and a second set of the signal conductors forming part of a second lead frame, the intermediate segments of the signal conductors in the first set being encased in the first overmolded body, the intermediate segments of the signal conductors in the second set being encased in the second overmolded body; and a ground frame held between the first and second overmolded bodies at the overmold interface, the ground frame including a ground bus bar and plural ground conductors joined to and extending from the ground bus bar, the ground bus bar extending across the signal conductors, the ground conductors defining mating ground contacts and terminating ground contacts arranged in the row and providing shielding between corresponding mating signal contacts and terminating signal contacts, respectively, wherein the second overmolded body is formed in-situ on the inner side of the first overmolded body, the inner side of the second overmolded body at the overmold interface being partially defined by a profile of the inner side of the first overmolded body and partially defined by the ground frame.

14. The connector sub-assembly of claim 13, wherein the signal conductors in the first set are arranged in pairs, the signal conductors in the second set being arranged in pairs that are disposed between adjacent pairs of the signal conductors in the first set.

15. The connector sub-assembly of claim 13, wherein the ground bus bar of the ground frame is planar and defines opposite top and bottom sides, the bottom side engaging the inner side of the first overmolded body, the top side engaging and at least partially defining a profile of the inner side of the second overmolded body.

16. The connector sub-assembly of claim 13, wherein the first overmolded body includes one or more protrusions that extend outward from the inner side of the first overmolded body, the second overmolded body forming around the one or more protrusions to define one or more corresponding depressions in the inner side of the second overmolded body.

17. The connector sub-assembly of claim 13, wherein the first overmolded body includes one or more depressions that extend inward from the inner side of the first overmolded body, the second overmolded body filling the one or more depressions to define one or more corresponding protrusions extending outward from the inner side of the second overmolded body.

18. The connector sub-assembly of claim 13, wherein the first overmolded body and the second overmolded body are composed of the same dielectric material.

19. The connector sub-assembly of claim 13, wherein the overmold interface defines an interface plane, the ground bus bar extending along the interface plane, the intermediate segments of the signal conductors in the first set being jogged to extend within the first overmolded body along a first encasement plane parallel to the interface plane, the intermediate segments of the signal conductors in the second set being jogged in an opposite direction relative to the signal conductors in the first set to extend within the second overmolded body along a second encasement plane parallel to the interface plane.

20. A method of assembling a connector sub-assembly for an electrical connector, the method comprising:

overmolding signal conductors of a first lead frame in a first overmolded body, the signal conductors being arranged in pairs, adjacent pairs of signal conductors being spaced apart from one another along a length of the first overmolded body;

mounting a ground frame on an inner side of the first overmolded body, the ground frame including a ground bus bar and grounding contacts that extend from the ground bus bar, a bottom side of the ground bus bar engaging the inner side of the first overmolded body;

positioning signal conductors of a second lead frame along the inner side of the first overmolded body, the signal conductors in the second lead frame being arranged in pairs that are each disposed laterally between adjacent pairs of the signal conductors in the first lead frame, intermediate segments of the signal conductors in the second lead frame being jogged around a top side of the ground bus bar that is opposite the bottom side such that the signal conductors are separated by a distance from the ground bus bar; and overmolding a second overmolded body over the inner side of the first overmolded body, the second overmolded body encasing the intermediate segments of the signal conductors in the second lead frame.

* * * * *